US012553677B2

(12) United States Patent
Wagner et al.

(10) Patent No.: US 12,553,677 B2
(45) Date of Patent: Feb. 17, 2026

(54) FIREARM WARNING ASSEMBLY

(71) Applicant: Ralstec Corporation, Mukwonago, WI (US)

(72) Inventors: Leslie A Wagner, Mukwonago, WI (US); Susan A Arndt, Saint Paul, MN (US)

( * ) Notice: Subject to any disclaimer, the term of this patent is extended or adjusted under 35 U.S.C. 154(b) by 0 days.

(21) Appl. No.: 18/601,857

(22) Filed: Mar. 11, 2024

(65) Prior Publication Data

US 2025/0283681 A1 Sep. 11, 2025

(51) Int. Cl.
*F41A 9/53* (2006.01)
*F41A 17/44* (2006.01)

(52) U.S. Cl.
CPC ..... *F41A 9/53* (2013.01); *F41A 17/44* (2013.01)

(58) Field of Classification Search
CPC .. F41A 17/44; F41A 9/53; F41A 17/54; F41A 35/02
See application file for complete search history.

(56) References Cited

U.S. PATENT DOCUMENTS

| | | | | | |
|---|---|---|---|---|---|
| 4,235,356 | A * | 11/1980 | Atchisson | F41C 33/0209 | 224/192 |
| 4,398,367 | A * | 8/1983 | Gamble | F41A 35/02 | 42/96 |
| 4,644,676 | A * | 2/1987 | Stern | F41A 17/54 | 42/70.07 |
| 5,313,733 | A * | 5/1994 | Meade | F41A 17/54 | 42/70.11 |
| 5,960,575 | A * | 10/1999 | Chiovitt | F41A 17/54 | 42/70.07 |
| D701,282 | S * | 3/2014 | Ferguson, II | D22/108 | |
| D827,761 | S * | 9/2018 | Rumpke | D22/108 | |
| 11,656,047 | B1 * | 5/2023 | Cole | F41A 9/53 | 42/1.05 |
| 2007/0006511 | A1 * | 1/2007 | Casas Salva | F41C 23/16 | 42/96 |
| 2022/0260331 | A1 * | 8/2022 | Meier | F41A 35/02 | |

* cited by examiner

*Primary Examiner* — Joshua E Freeman

(57) ABSTRACT

A firearm warning assembly includes a band comprising a first edge region having an insert hole and a second edge region opposite the first edge region having an attachment hole and an attachment insert. The attachment insert includes a base and a post extending from the base and engageable with the insert hole. A method includes engaging an attachment insert comprising a base and a post extending from the base with an insert hole in a first edge region of a band, positioning the band around a firearm, and engaging the post with an attachment hole in a second edge region of the band opposite the first edge region to secure the band to the firearm.

25 Claims, 5 Drawing Sheets

FIREARM WARNING ASSEMBLY

BACKGROUND

The present disclosure relates generally to a warning system for a firearm, such as a firearm warning assembly including a band that engages the firearm and an indicator that indicates an unloaded state of the firearm.

Various devices may be used to increase firearm safety. Lock boxes or safes may restrict access to a firearm. Bands or locks may cover or inhibit operation of a trigger mechanism for discharging a firearm. Such devices do not provide an indication of the loaded or unloaded state of the firearm.

BRIEF DESCRIPTION OF THE DRAWINGS

The present disclosure may be better understood, and its numerous features and advantages made apparent to those skilled in the art, by referencing the accompanying drawings. The use of the same reference symbols in different drawings indicates similar or identical items.

DETAILED DESCRIPTION

Figure 1A:
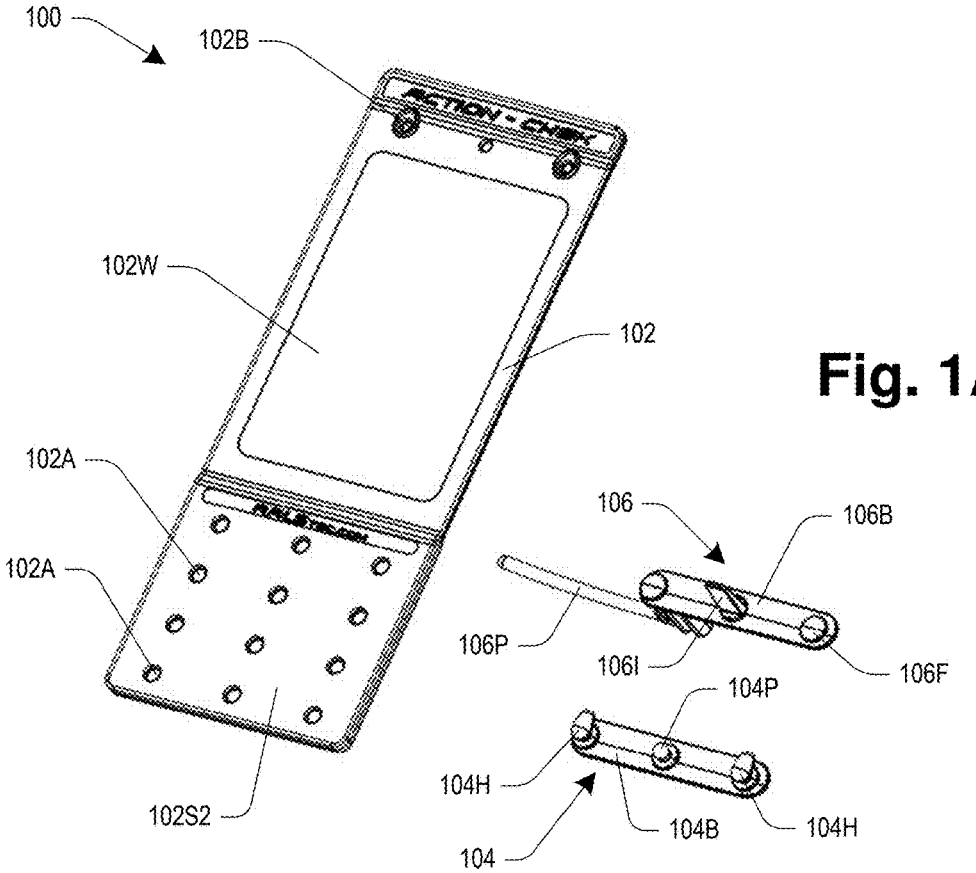
FIGS. 1A and 1B are front isometric views of a firearm warning assembly, in accordance with some embodiments.
Figure 1B:
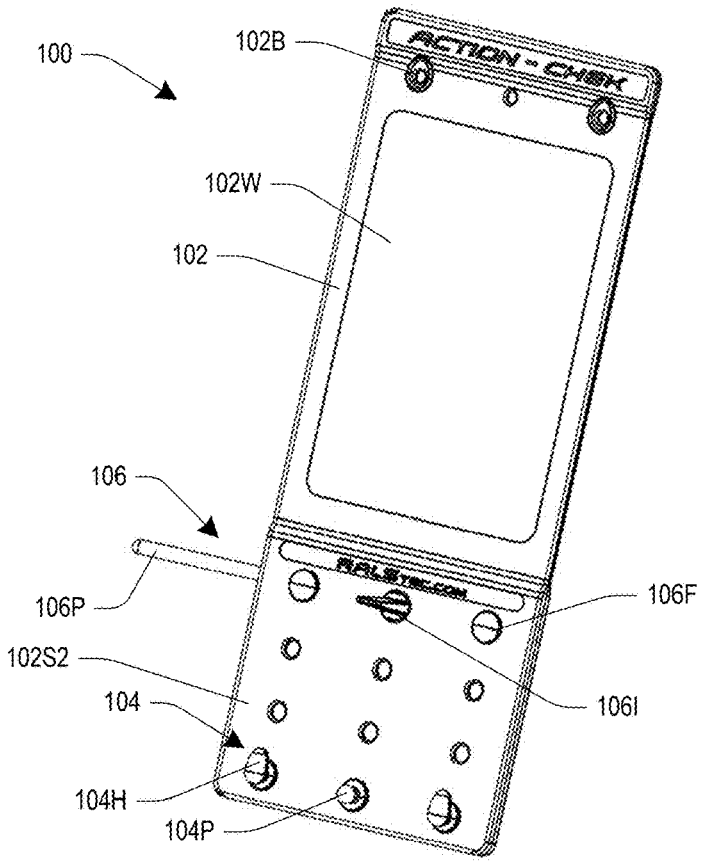
Figure 2A:
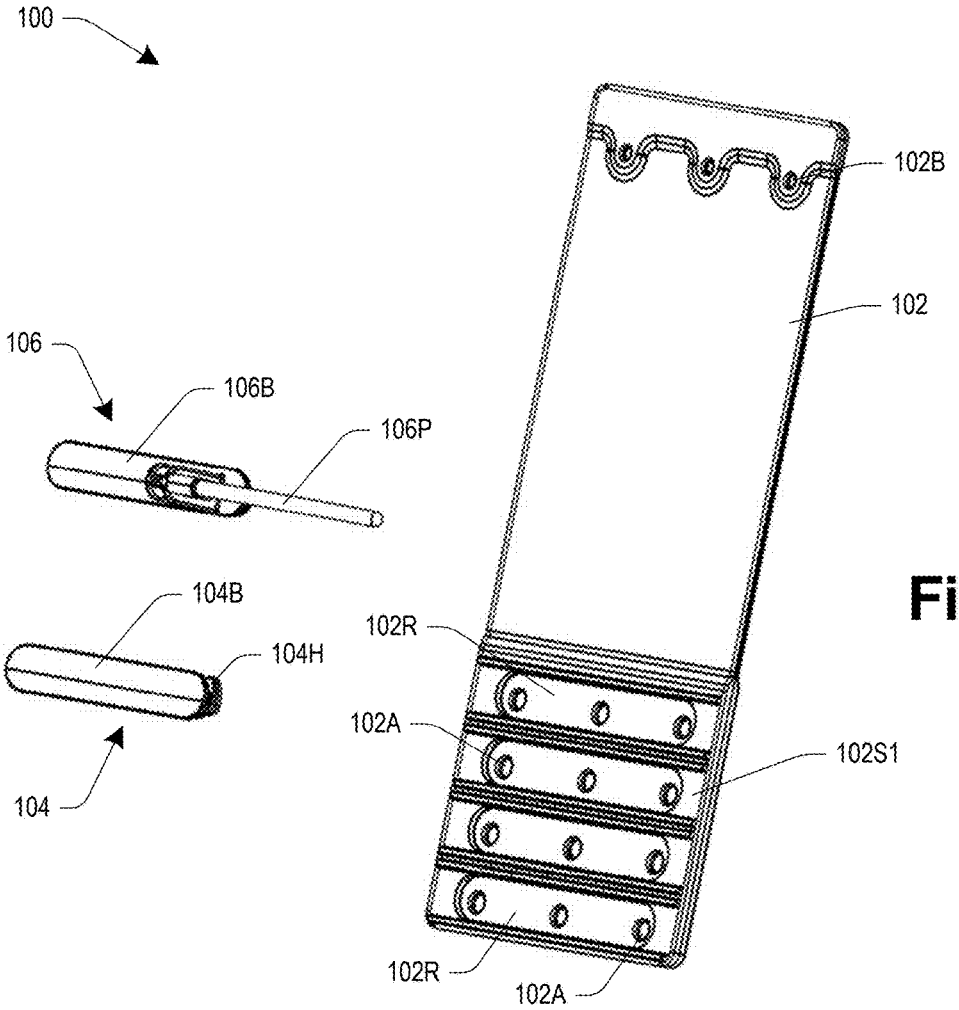
FIGS. 2A and 2B are back isometric views of the firearm warning assembly, in accordance with some embodiments.
Figure 2B:
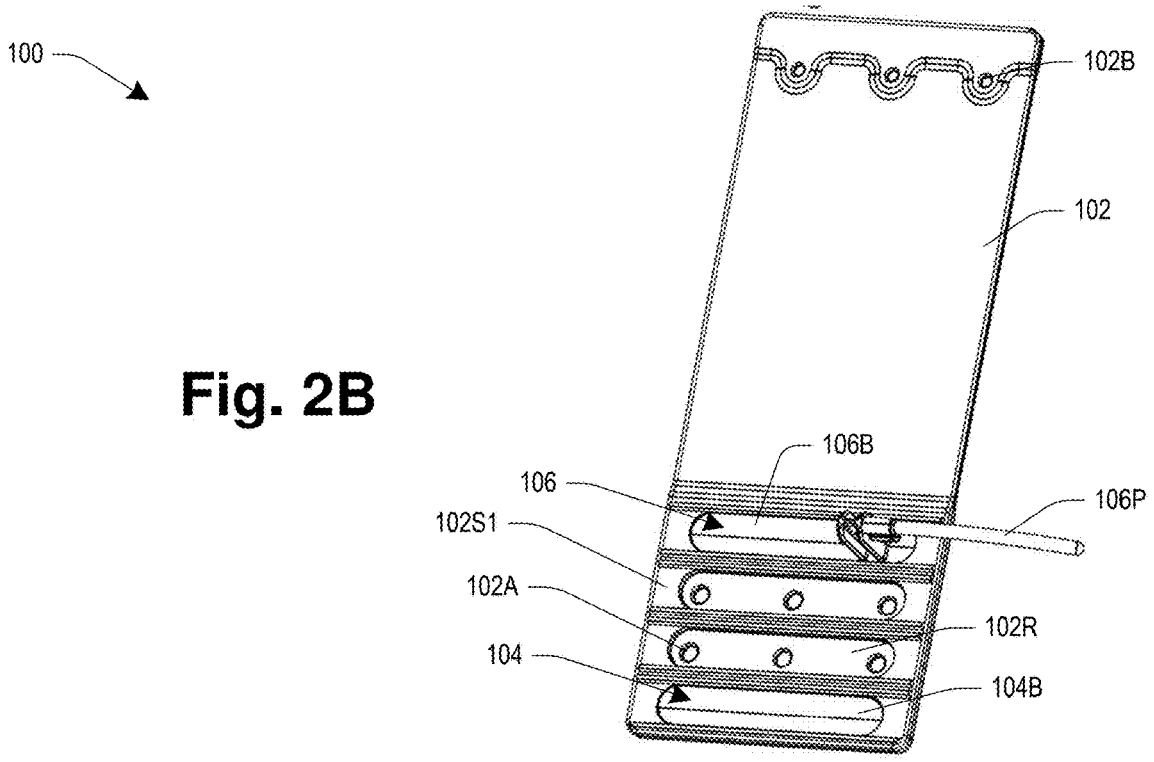
Figure 3:
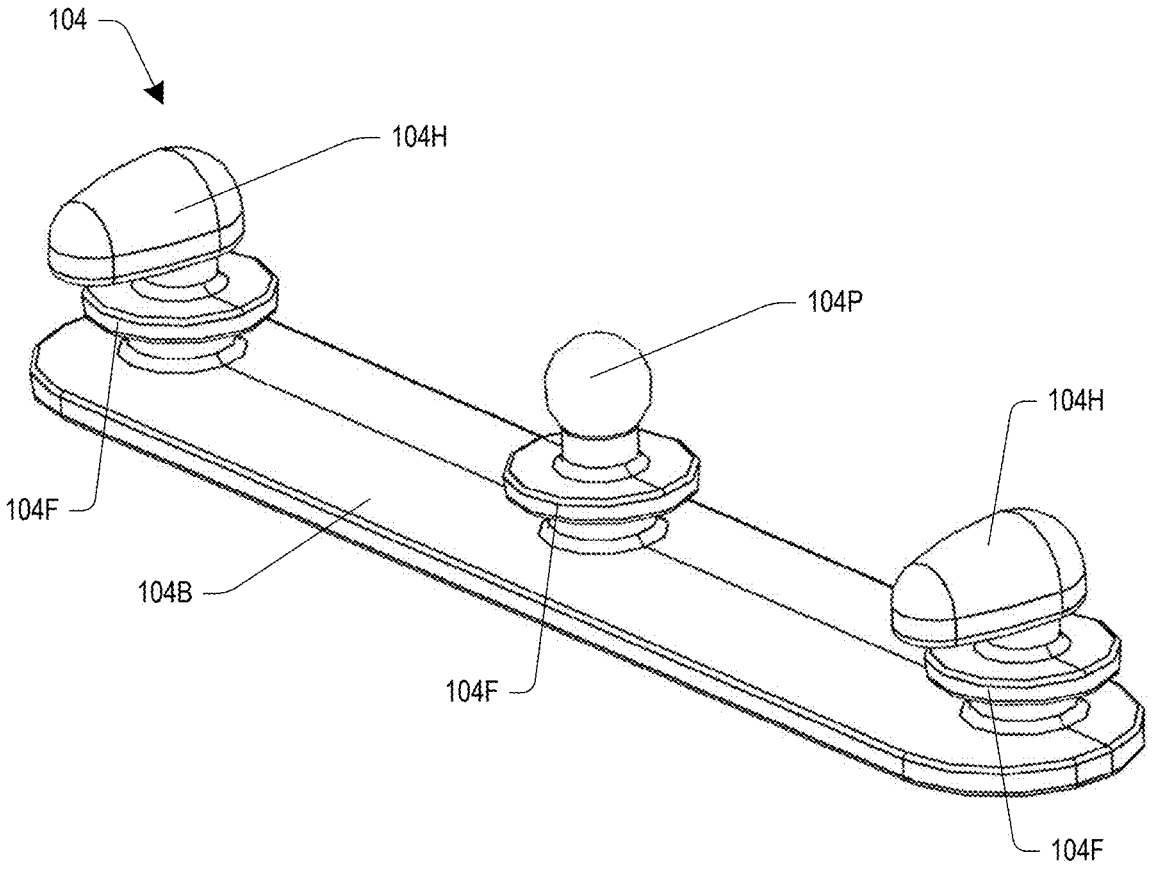
FIG. 3 is an isometric view of an attachment insert, in accordance with some embodiments.
Figure 4A:
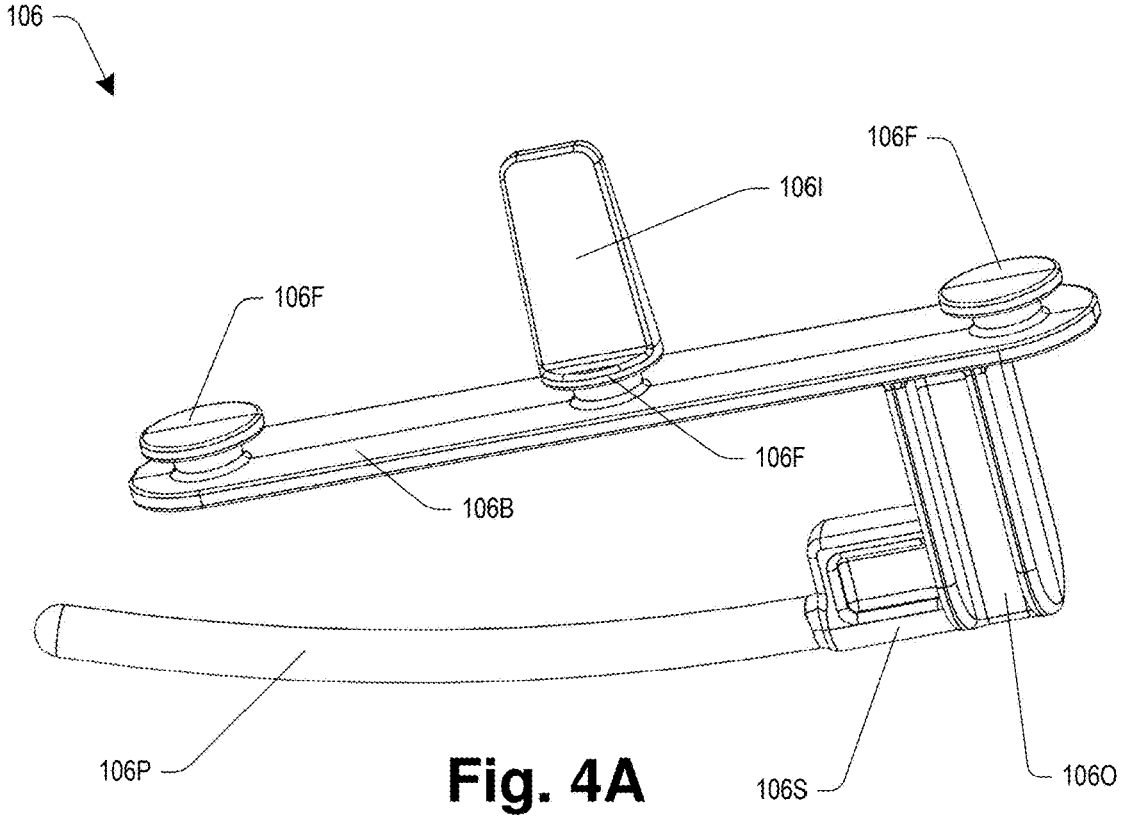
FIGS. 4A and 4B are front are isometric views of chamber plug inserts, in accordance with some embodiments.
Figure 4B:
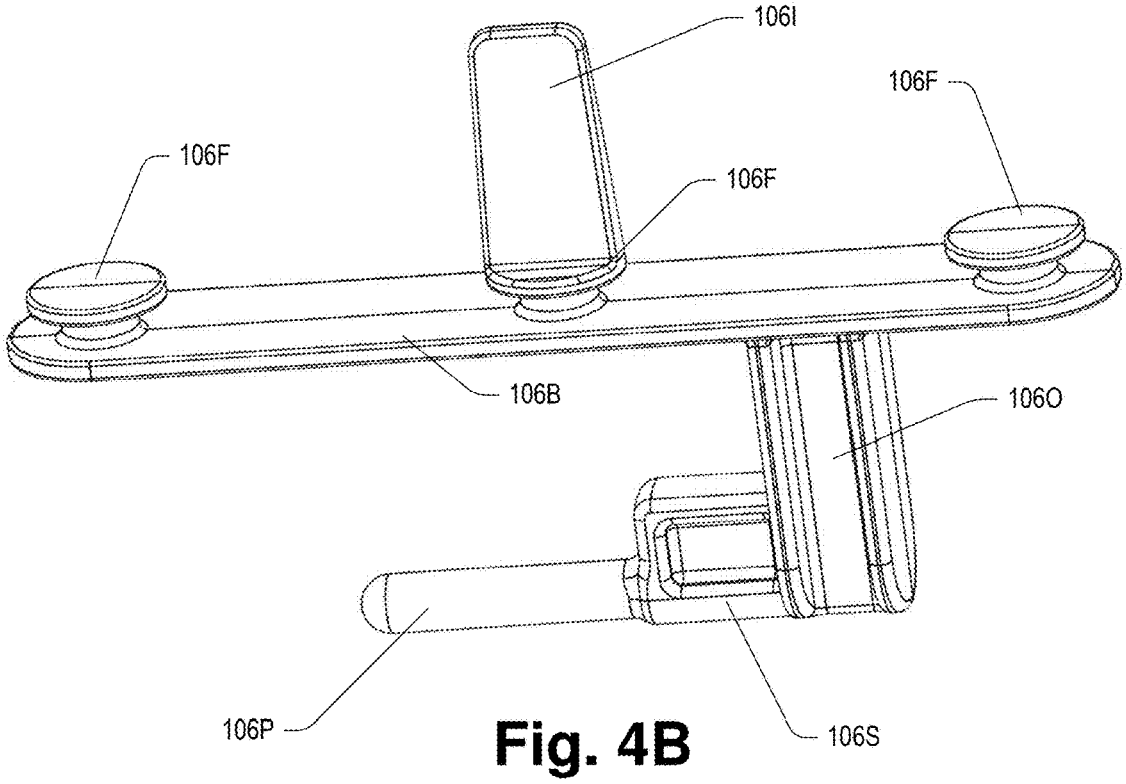

FIGS. 1A, 1B, 2A, 2B, 3, 4A, 4B and 5 illustrate example embodiments of a firearm warning assembly 100. FIGS. 1A and 1B are front isometric views of the firearm warning assembly 100 and FIGS. 2A and 2B are back isometric views of the firearm warning assembly 100, in accordance with some embodiments. In some embodiments, the firearm warning assembly 100 comprises a band 102, an attachment insert 104, and a chamber plug insert 106. FIG. 3 is an isometric view of the attachment insert 104, in accordance with some embodiments. FIGS. 4A and 4B are front are isometric views of chamber plug inserts 106, in accordance with some embodiments. The front views of FIGS. 1A and 1B represent the outer surface 102S2 of the firearm warning assembly 100 that would be visible when the firearm warning assembly 100 is installed on a firearm, and the back views of FIGS. 2A and 2B represent the inner surface 102S1 of the firearm warning assembly 100 that would engage the firearm.

In some embodiments, the band 102 includes insert holes 102A to facilitate positioning of the attachment insert 104 and the chamber plug insert 106 and attachment holes 102B for engaging the attachment insert 104. The holes 102A, 102B may be arranged in rows. The number of rows and the number of holes 102A, 102B in each row may vary to provide flexibility for positioning the inserts 104, 106. Recesses 102R may be provided proximate the insert holes 102A to allow the inserts 104, 106 to be inset with respect to an inner surface 102S1 of the band 102. The position of the attachment insert 104 in the insert holes 102A may vary depending on the size of the firearm such that the band 102 is stretched when installed on the firearm to increase the reliability of the engagement. The band 102 may be expandable and contractible along more than one axis. In some embodiments, the attachment insert 104 may be inserted into the holes 102B and engage the holes 102A to secure the band 102. In some embodiments, the band 102 comprises an indicia window 102W where warning text or instructions may be provided and visible to the user when the firearm warning assembly 100 is installed on a firearm.

In some embodiments, the chamber plug insert 106 engages a chamber of the firearm to provide an indication that the chamber is empty and the firearm is unloaded. If the firearm were to be loaded, the chamber plug insert 106 would not interface with the firearm. Thus, the chamber plug insert 106 provides a visual indication of the unloaded state of the firearm. The position of the chamber plug insert 106 in the insert holes 102A may vary depending on the relative position of the chamber of the firearm.

In some embodiments, as shown in more detail in FIG. 3, the attachment insert 104 comprises a base 104B and posts 104H, 104P extending from the base 104B. In the illustrated embodiment, the posts 104H have hook shaped ends, and the post 104B has a ball shaped end. The number of posts 104H, 104P may vary. Flanges 104F may be provided on the posts 104H, 104P in intermediate positions along the length of the posts 104H, 104P for engaging the band 102, such that the band 102 is retained between the base 104B and the flanges 104F.

In some embodiments, as shown in more detail in FIGS. 4A and 4B, the chamber plug insert 106 comprises a base 106B, posts 106F extending from the base 106B, a chamber plug 106P, and an indicator 1061 extending from the base 106B. In some embodiments, the indicator 1061 is positioned in a middle region of the base 106B and the chamber plug 106P is positioned in an end region and axially aligned with one of the posts 106F. Alternatively, the indicator 1061 and the chamber plug 106P may be axially aligned. The number of posts 106F may vary. In the illustrated embodiment, the posts 106F have flanged ends for engaging the band 102, such that the band 102 is retained between the base 106B and the posts 106F. The indicator 1061 extends from the base 106B in a direction opposite to the direction of the chamber plug 106P such that the indicator 1061 is visible on an outside surface 102S2 of the band 102 when installed on a firearm to provide a visual indication of the unloaded state of the firearm. The chamber plug 106P has an offset portion 1060 extending from the base 106B into the receiver of the firearm such that a plug base portion 106S positions the plug 106P such that it passes through the center of the firearm. A base portion 106S of chamber plug 106P is sized to approximately ride on the inside chamber wall of the firearm. The chamber plug 106P extends into the breech of the chamber of the firearm when the firearm is in an unloaded state.

In the embodiment of FIG. 4A, the chamber plug 106P is elongated and curved to facilitate insertion of the chamber plug 106P into the chamber of a shotgun or a rifle with a relatively long breech. FIG. 4B illustrates an alternative embodiment of the chamber plug 106P that is barrel shaped to facilitate insertion of the chamber plug 106P into the chamber of a handgun with a shorter breech.

Figure 5A:
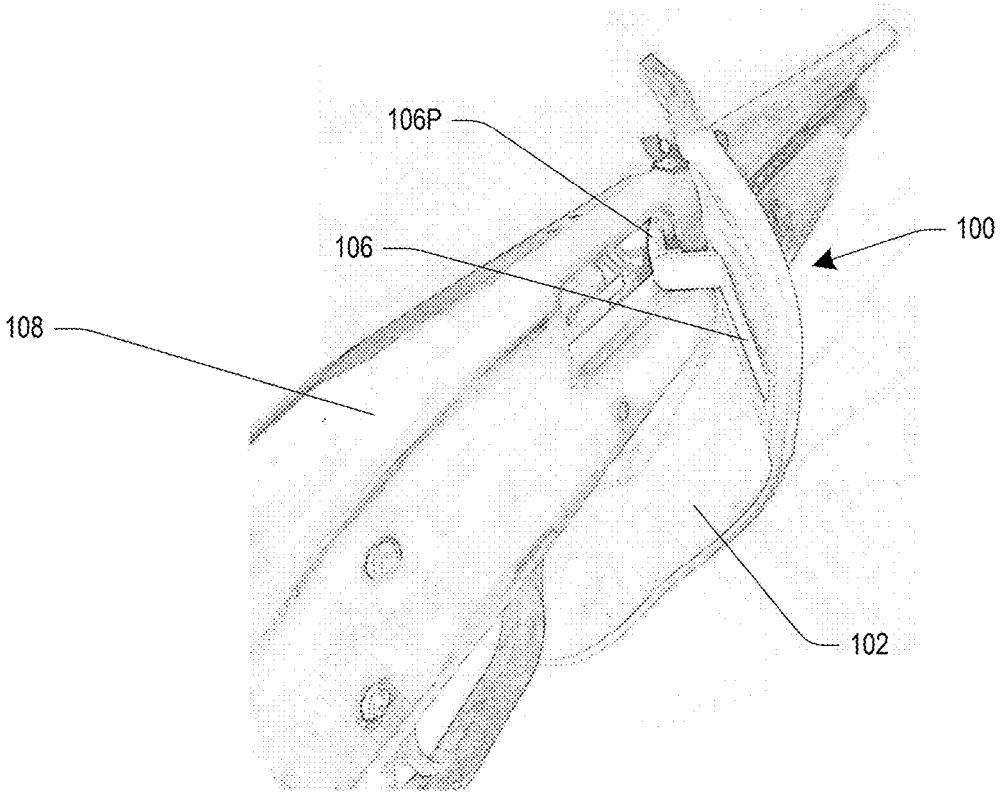
FIGS. 5A and 5B are isometric views of the firearm warning assembly being installed on a firearm, in accordance with some embodiments.
Figure 5B:
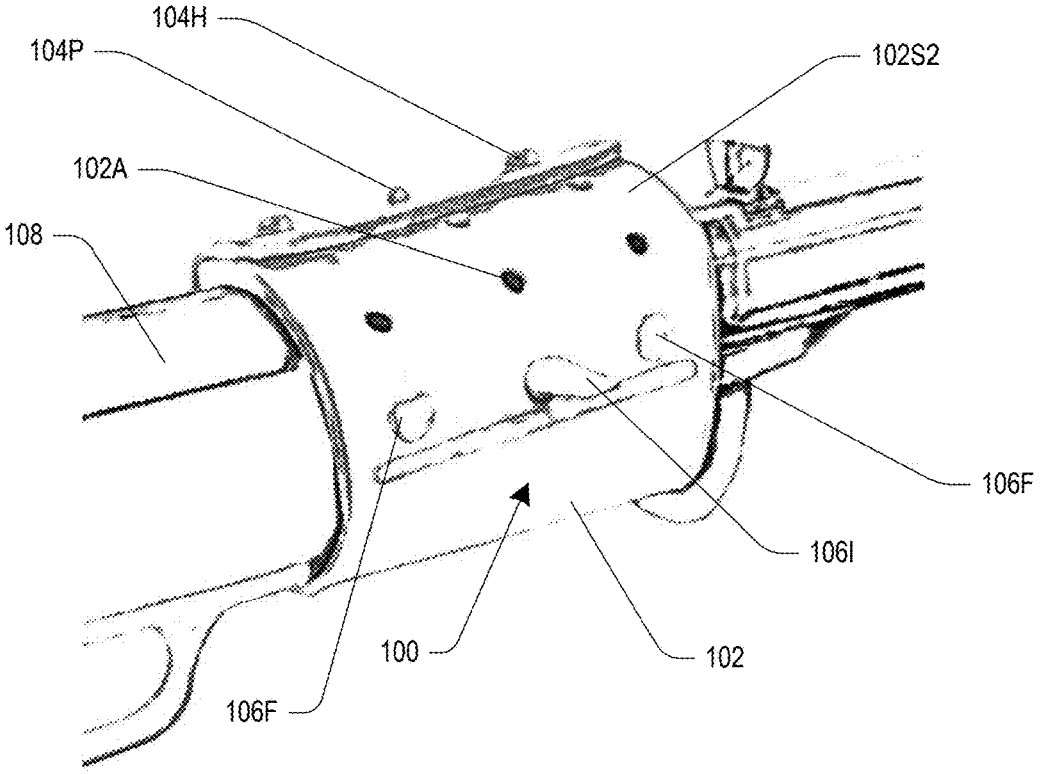

FIGS. 5A and 5B are isometric views of a firearm warning assembly 100 being installed on a firearm 108, in accordance with some embodiments. When the firearm warning assembly 100 is installed on the firearm 108, the band 102 is wrapped around the firearm 108 to prevent access to the chamber. In some embodiments, the band 102 may also be wrapped around the trigger guard if the chamber and trigger guard are aligned, for example, with a handgun. A user may select the chamber plug insert 106 appropriate to the firearm 108 (e.g., the chamber plug insert 106 of FIG. 4A or FIG. 4B) and position the chamber plug insert 106 in the insert holes 102A depending on the location of the chamber. The user inserts the chamber plug 106P of the chamber plug insert 106 into the chamber of the firearm as show in in FIG. 5A and then wraps the band 102 around the firearm 108. The user applies enough force to at least slightly stretch the band 102 to align the posts 104H, 104P with the insert holes 102A in the band 102 and engage the band 102 as shown in FIG. 5B. The stretching of the band 102 allows better engagement with the posts 104H with hook shaped ends. The indicator 1061 extends is visible on an outside surface 102S2 of the band 102 when installed on the firearm 108 to provide a visual indication of the unloaded state of the firearm 108.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A firearm warning assembly, comprising:
a band; and
a chamber plug insert engageable with the band and comprising:
a first base;
a chamber plug extending from the first base in a first direction; and
an indicator extending from the first base in a second direction opposite the first direction.

2. The firearm warning assembly of claim 1, wherein:
the band comprises a first edge region having an insert hole and a second edge region opposite the first edge region having an attachment hole;
the firearm warning assembly comprises:
an attachment insert, comprising:
a second base; and
a post extending from the second base and engageable with the insert hole; and
the post has a hook shaped end portion.

3. The firearm warning assembly of claim 1, comprising:
an attachment insert, comprising:
a second base;
a first post extending from the second base; and
a second post extending from the second based, wherein:
the band comprises a first edge region having a first insert hole and a second insert hole and a second edge region opposite the first edge region having a first attachment hole and a second attachment hole;
the first post is engageable with the first insert hole;
the second post is engageable with the second insert hole;
the post comprises a hook shaped end portion; and
the second post comprises a ball shaped end portion.

4. The firearm warning assembly of claim 1, wherein:
the band comprises a first edge region having an insert hole, a second edge region opposite the first edge region having an attachment hole, and a recess;
the firearm warning assembly comprises:
an attachment insert, comprising:
a base; and
a post extending from the base and engageable with the insert hole; and
the base of the attachment insert is positionable in the recess.

5. The firearm warning assembly of claim 1, wherein:
the band comprises a first edge region having an insert hole and a second edge region opposite the first edge region having an attachment hole;
the firearm warning assembly comprises:
an attachment insert, comprising:
a base; and
a post extending from the base and engageable with the insert hole; and
the post of the attachment insert has a flange positioned in an intermediate position along a length of the post.

6. The firearm warning assembly of claim 1, wherein:
the band comprises a first edge region having rows of holes and a second edge region opposite the first edge region having an attachment hole;
the firearm warning assembly comprises:
an attachment insert, comprising:
a base; and
a post extending from the base and engageable with one of the holes in the rows of holes.

7. The firearm warning assembly of claim 1, wherein:
the band comprises a first edge region having a first insert hole and a second edge region opposite the first edge region having an attachment hole;
the firearm warning assembly comprises:
an attachment insert, comprising:
a first base; and
a first post extending from the first base and engageable with the insert hole;
the band comprises a second insert hole in one of the first edge region or the second edge region; and
the chamber plug insert comprises a second post extending from the second base in the second direction and engageable with the second insert hole.

8. The firearm warning assembly of claim 7, wherein:
the band comprises rows of holes in the first edge region;
the first insert hole is in a first row of the rows of holes; and the second insert hole is in a second row of the rows of holes.

9. The firearm warning assembly of claim 7, wherein:

the second post has a flange shaped end portion.

10. The firearm warning assembly of claim 1, wherein:

the band comprises a first edge region having an insert hole and a second edge region opposite the first edge region having an attachment hole;

the firearm warning assembly comprises:

an attachment insert, comprising:

a second base; and a post extending from the second base and engageable with the insert hole.

11. A method, comprising:

engaging a chamber plug insert comprising a first base, a chamber plug extending from the first base in a first direction, and an indicator extending from the first base in a second direction opposite the first direction with a band;

inserting the chamber plug in a chamber of a firearm; and positioning the band around the firearm.

12. The method of claim 11, comprising:

engaging an attachment insert comprising a base and a post extending from the base with an insert hole in a first edge region of the band; and stretching the band to engage the post with an attachment hole in a second edge region of the band opposite the first edge region to secure the band to the firearm, wherein:

the post of the attachment insert has a hook shaped end portion.

13. The method of claim 11, comprising:

engaging an attachment insert comprising a base and a post extending from the base with an insert hole in a first edge region of the band; and engaging the post with an attachment hole in a second edge region of the band opposite the first edge region to secure the band to the firearm, wherein:

the band comprises a recess; and engaging the attachment insert comprises positioning the base of the attachment insert in the recess.

14. The method of claim 11, comprising:

engaging an attachment insert comprising a base and a post extending from the base with an insert hole in a first edge region of the band; and engaging the post with an attachment hole in a second edge region of the band opposite the first edge region to secure the band to the firearm, wherein:

the post of the attachment insert has a flange positioned in an intermediate position along a length of the post; and engaging the attachment insert comprises positioning the band between the base and the flange.

15. The method of claim 11, comprising:

engaging an attachment insert comprising a base and a post extending from the base with an insert hole in a first edge region of the band; and engaging the post with an attachment hole in a second edge region of the band opposite the first edge region to secure the band to the firearm, wherein:

the band comprises rows of holes in the first edge region; and engaging the attachment insert comprises selecting the insert hole in one of the rows of holes for positioning the attachment insert.

16. The method of claim 11, comprising:

engaging an attachment insert comprising a base and a post extending from the base with a first insert hole in a first edge region of the band; and engaging the post with an attachment hole in a second edge region of the band opposite the first edge region to secure the band to the firearm, wherein:

the band comprises a second insert hole in one of the first edge region or the second edge region;

the chamber plug insert comprises a second post extending from the second base in the second direction; and engaging the chamber plug insert comprises engaging the second post with the second insert hole.

17. The method of claim 16, wherein:

the band comprises rows of holes in the first edge region;

the first insert hole for engaging the attachment insert is in a first row of the rows of holes; and engaging the chamber plug insert comprises selecting the second insert hole in a second row of the holes different than the first row.

18. The method of claim 11, comprising:

engaging an attachment insert comprising a base and a post extending from the base with an insert hole in a first edge region of the band; and engaging the post with an attachment hole in a second edge region of the band opposite the first edge region to secure the band to the firearm.

19. An apparatus, comprising:

a firearm comprising a chamber and a control;

a firearm warning assembly, comprising:

a band comprising a first edge region having an insert hole and a second edge region opposite the first edge region having an attachment hole; and an attachment insert, comprising:

a base; and a post extending from the base and engageable with the insert hole and the attachment hole to position the band over the control of the firearm;

a chamber plug insert engageable with the band and comprising:

a second base;

a chamber plug extending from the second base in a first direction and positioned in the chamber of the firearm; and an indicator extending from the second base in a second direction opposite the first direction.

20. The apparatus of claim 19, wherein:

the band comprises a second insert hole in one of the first edge region or the second edge region; and the chamber plug insert comprises a second post extending from the second base in the second direction and engageable with the second insert hole.

21. A firearm warning assembly, comprising:

a band comprising:

a first edge region having a first insert hole and a second insert hole; and a second edge region opposite the first edge region having a first attachment hole and a second attachment hole; and an attachment insert, comprising:

a base;

a first post comprising a hook shaped end portion extending from the base and engageable with the first insert hole; and a second post comprising a ball shaped end portion extending from the base and engageable with the second insert hole.

22. The firearm warning assembly of claim 21, wherein:
the band comprises a recess; and
the base of the attachment insert is positionable in the recess.

23. A firearm warning assembly, comprising:
a band comprising:
a first edge region having an insert hole;
a second edge region opposite the first edge region having an attachment hole; and
a recess; and
an attachment insert, comprising:
a base positionable in the recess; and
a post extending from the base and engageable with the insert hole.

24. A method, comprising:
engaging a first post comprising a hook shaped end portion extending from a base of an attachment insert with a first insert hole in a first edge region of a band;
engaging a second post comprising a ball shaped end portion extending from the based of the attachment insert with a second insert hole in the first edge region of a band;
positioning the band around a firearm; and
securing the band to the firearm by:
engaging the first post with a first attachment hole in a second edge region of the band opposite the first edge region; and
engaging the second post with a second attachment hole in the second edge region of the band.

25. A method, comprising:
engaging an attachment insert comprising a base and a post extending from the base with an insert hole in a first edge region of a band;
positioning the band around a firearm; and
engaging the post with an attachment hole in a second edge region of the band opposite the first edge region to secure the band to the firearm, wherein:
the post of the attachment insert has a flange positioned in an intermediate position along a length of the post; and
engaging the attachment insert comprises positioning the band between the base and the flange.

* * * * *